US007389958B2

(12) United States Patent
Haapanen

(10) Patent No.: US 7,389,958 B2
(45) Date of Patent: Jun. 24, 2008

(54) CORE LOCKING DEVICE

(75) Inventor: Jaakko Haapanen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 533 days.

(21) Appl. No.: 10/534,907

(22) PCT Filed: Nov. 11, 2003

(86) PCT No.: PCT/FI03/00853

§ 371 (c)(1),
(2), (4) Date: Jun. 3, 2005

(87) PCT Pub. No.: WO2004/046004

PCT Pub. Date: Jun. 3, 2004

(65) Prior Publication Data

US 2006/0038052 A1 Feb. 23, 2006

(30) Foreign Application Priority Data

Nov. 15, 2002 (FI) ..... 20022037

(51) Int. Cl.
*B65H 18/14* (2006.01)

(52) U.S. Cl. ..... 242/542; 242/541.3; 242/542.2; 242/542.3

(58) Field of Classification Search ..... 242/542, 242/542.1–542.4, 541.3
See application file for complete search history.

(56) References Cited

U.S. PATENT DOCUMENTS 3,848,826 A * 11/1974 Voswinckel ..... 242/542
3,869,095 A * 3/1975 Diltz ..... 242/531
4,565,337 A * 1/1986 Mondini et al. ..... 242/541.7
4,673,137 A * 6/1987 Bachinger et al. ..... 242/548
4,749,140 A 6/1988 Ruff
4,887,926 A 12/1989 Kunz
5,620,151 A 4/1997 Ueyama et al.
5,639,045 A 6/1997 Dörfel
6,820,834 B1 * 11/2004 Niskanen ..... 242/541.3

FOREIGN PATENT DOCUMENTS

| | | | |
|---|---|---|---|
| DE | 35 40 490 | C1 | 3/1987 |
| DE | 40 17 723 | A1 | 12/1991 |
| EP | 0 887 293 | A2 | 6/1998 |
| EP | 1 108 669 | A2 | 11/2000 |
| GB | 841305 | | 7/1960 |
| WO | WO 03/089352 | A1 | 10/2003 |
| WO | WO 2004/046004 | A1 | 6/2004 |

OTHER PUBLICATIONS

PCT International Preliminary Examination Report issued in PCT/FI03/00853 PCT.
International Search Report issued in PCT/FI03/00853.
Search Report issued in Finnish App. No. 20022037.

* cited by examiner

*Primary Examiner*—Sang Kim
(74) *Attorney, Agent, or Firm*—Stiennon & Stiennon

(57) ABSTRACT

A core locking device has members (25) for locking the device (17) to a winding core of a roll to be wound on a two-drum winder, advantageously to a core. The device (17) is placed on a slide arranged in connection with the two-drum winder, and moves, as winding progresses, with the center of the roll being formed along the slide. The device (17) has an actuator (20) to produce a counterforce for the force caused by the mass of the core locking device (17) in the changed position of the core locking device (17).

18 Claims, 3 Drawing Sheets

CORE LOCKING DEVICE

CROSS REFERENCES TO RELATED APPLICATIONS

This application is a U.S. national stage application of International App. No. PCT/FI2003/000853, filed Nov. 11, 2003, the disclosure of which is incorporated by reference herein, and claims priority on Finnish App. No. 20022037, Filed Nov. 15, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to core locking devices.

In the prior art, slitter-winders are known in which two-drum winders are used for winding component rolls after slitting a web. In the prior art there are known variable geometry two-drum winders in which one or both of the winding drums/sets of drums supporting the roll are movable. In such variable geometry slitter-winders, the horizontal location of the center of the roll that is building up is dependent on the relative position of the winding drums/sets of drums and on the diameter of the roll. In winders, rolls are wound around cores. Longitudinal successive cores are locked in place to form a core line by means of a core locking device placed at both ends. In the prior art, a core locking device is known which is placed on a slide arranged in connection with a winder so as to be movable when the diameter of the roll increases as its center is displaced. Thus, the position of the core locking device changes during operation. The position of the core locking device that moves upwards on the slide also changes when the pivoting angle changes while in the variable geometry winder one or both drums move as winding progresses. When the core locking device pivots, the pivoted core locking device causes a force in the center of the roll, which force is dependent on the pivoting angle and on the mass of the device. This may cause problems during winding because the magnitude of the force cannot be affected.

In addition, in the prior art two-drum winders, mechanical guides, which limit the utilization of space, have been used for set change for guiding the core locking device to a correct position according to core size.

One problem with winding is also the so-called bouncing phenomenon in which a roll/rolls start bouncing in the winder.

SUMMARY OF THE INVENTION

An object of the invention is to provide a core locking device in which the changing of the position of the core chuck as winding progresses does not cause winding problems nor a force acting on the center of the roll.

A non-indispensable further object of the invention is to provide an arrangement in which no mechanical guides limiting the utilization of space are needed for set change in the two-drum winder. Further, a non-indispensable additional feature of the invention is to create an arrangement which makes it possible to detect the occurrence of a bouncing phenomenon and, when needed, to eliminate it.

In accordance with the invention, an actuator is placed in connection with the core locking device, preferably in connection with a pivot joint of the core locking device, which actuator produces a counterforce that is equal to the force caused by the mass of the core locking device in the changed position of the core chuck. In that connection, the core locking device is "weightless" at all pivoting angles, thus not affecting winding and the structure of the roll. The force caused by mass can be static and/or dynamic.

During set change, in the device in accordance with the invention, the device is driven by means of a relief actuator to a correct position depending on core size. When the roll positions, diameters and the core diameter are known, the position of the core center can be calculated.

The invention can also be made use of in case it is desired to measure the effect of horizontal forces on the winding process or to tune the actuator to function either as an active damper or as a passive damper. Passive damping can be accomplished, for example, when using a hydraulic actuator, such that flow is throttled or flow is restricted, i.e. the damping of the system is changed. In active damping, the position/pressure of the actuator is measured and the variable that determines the action of the actuator is changed based on the result of measurement.

In accordance with an advantageous additional application of the invention, the device can be used for detecting the bouncing phenomenon when an angle sensor that measures the pivoting angle is placed in connection with the actuating member; the bouncing phenomenon can be detected based on the measurements of the angle sensor and, when needed, a counterforce can be produced by means of the actuator to eliminate the bouncing phenomenon.

In addition, in two-drum winders which use as one winding drum a set of drums with a belt disposed around it, the device in accordance with the invention makes it possible to compensate for the change of the starting position of winding caused by wear of the belt. Wear of the belt affects the location of the core and thus also the location of the locking device. When the locking device is lowered onto the drums, the device can be "calibrated" and wear of the belt can also be inferred from the starting position.

The invention is particularly suitable for two-drum winders in which the rear winding drum is arranged to be movable. In two-drum winders the movement of the rear drum makes it possible to affect the winding properties and achieve quick set change.

In accordance with the invention, the state of the actuating member is advantageously measured in the center of a joint, for example, by means of an angle sensor placed at the end of the joint or by means of a distance measuring sensor or a force sensor placed inside the actuator, preferably a cylinder, thus making it possible to produce a counterforce of desired magnitude in order that the force caused by the core chuck in the center of the roll shall not cause winding problems.

In the following, the invention will be described in greater detail with reference to the figures of the appended drawing, but the invention is by no means meant to be narrowly limited to the details of them.

DESCRIPTION OF THE PREFERRED EMBODIMENTS

Figure 1B:
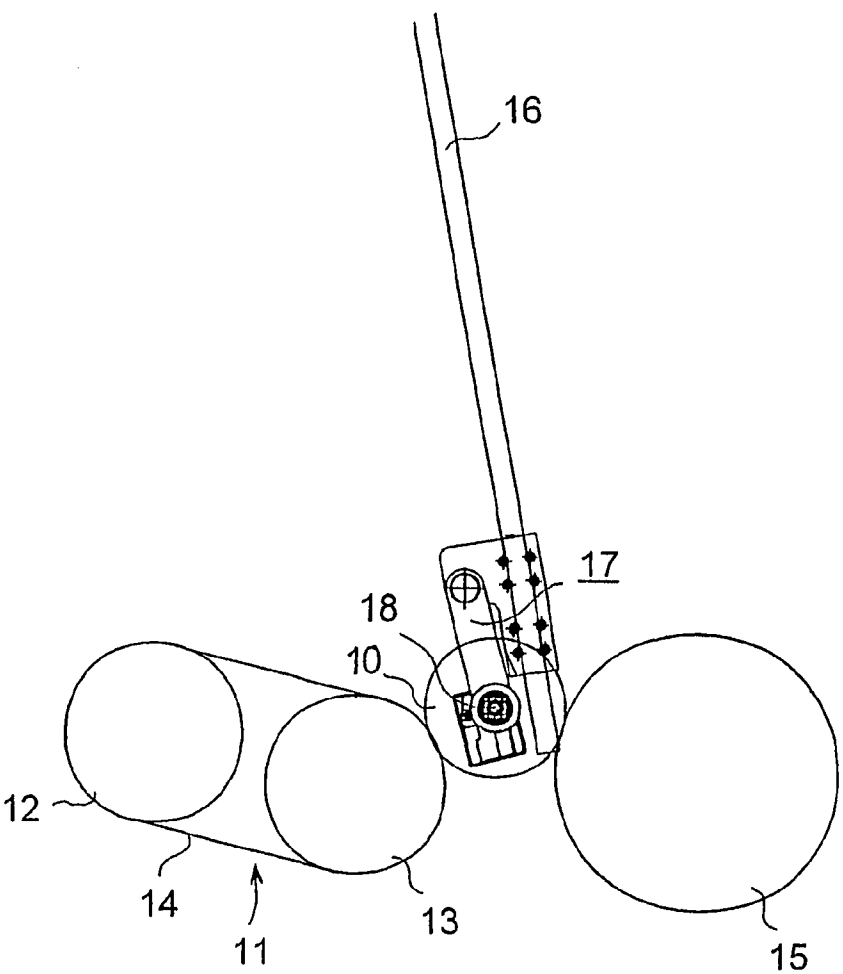
FIGS. 1A and 1B schematically show a variable geometry two-drum winder and a core locking device placed in connection therewith, in extreme positions of the core locking device.
Figure 1A:
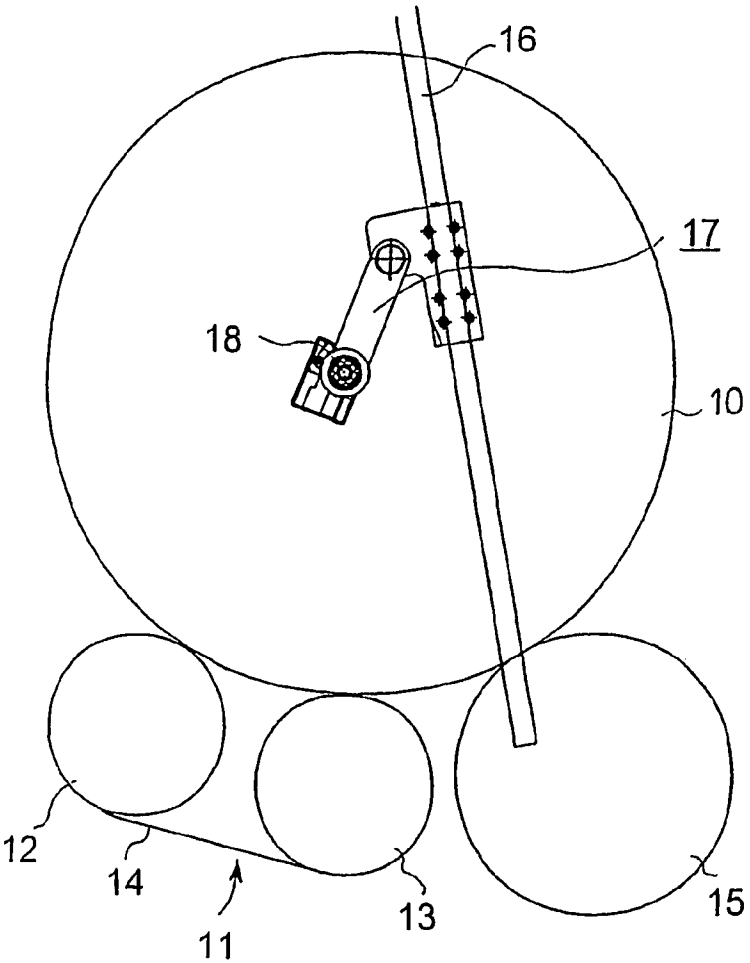

As shown in FIGS. 1A and B, a paper roll 10 is wound on a two-drum winder which, in the application shown in the figures, is formed of a set of belt drums 11 in which an endless belt 14 is placed around two drums 12, 13. The other set of drums of the two-drum winder is formed of a drum 15.

FIGS. 1A and B show two different phases of winding, of which the situation occurring in the end phases of winding is shown in FIG. 1A and the situation occurring in the initial phase of winding is shown in FIG. 1B.

At the beginning of winding, as shown in FIG. 1B, a core locking device, i.e. a core chuck 17 is situated on a slide 16 in a lower position, and an arm 21 of the core locking device (FIG. 2) has not pivoted around a joint 24 (FIG. 2). In that connection, the core locking device 17 does not produce a force in the center 18 of the roll 10. When winding has made progress, FIG. 1A, the core locking device 17 moves with the center 18 of the roll being formed forwards on the slide 16, so that the core locking device 17 will gradually be at an angle with respect to the slide 16, with the result that a force is produced in the center 18 of the roll 10 because of the weight of the core locking device 17.

Figure 2B:
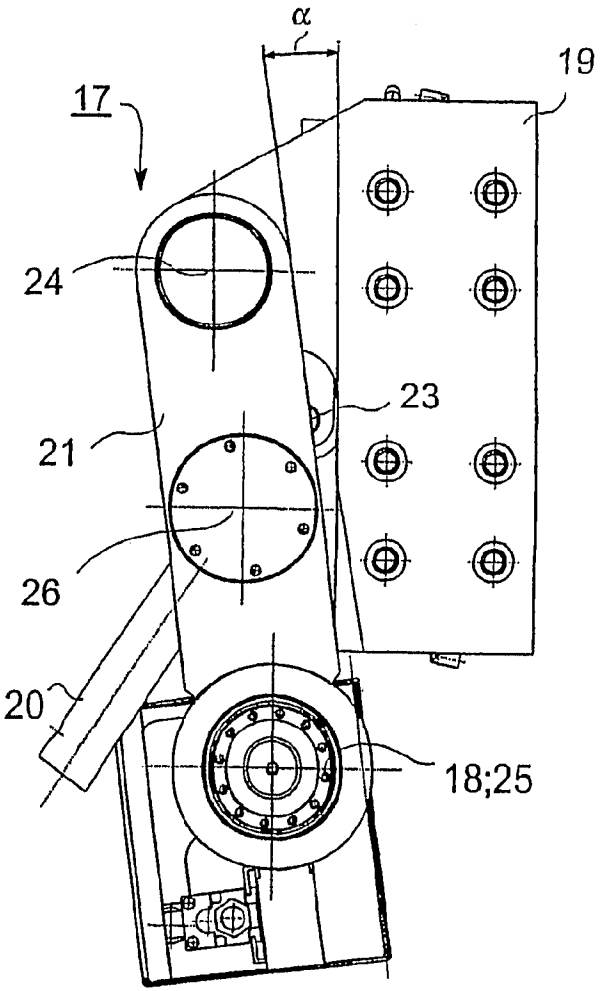
FIGS. 2A and 2B schematically show extreme positions of the core locking device in accordance with one exemplifying embodiment of the invention.
Figure 2A:
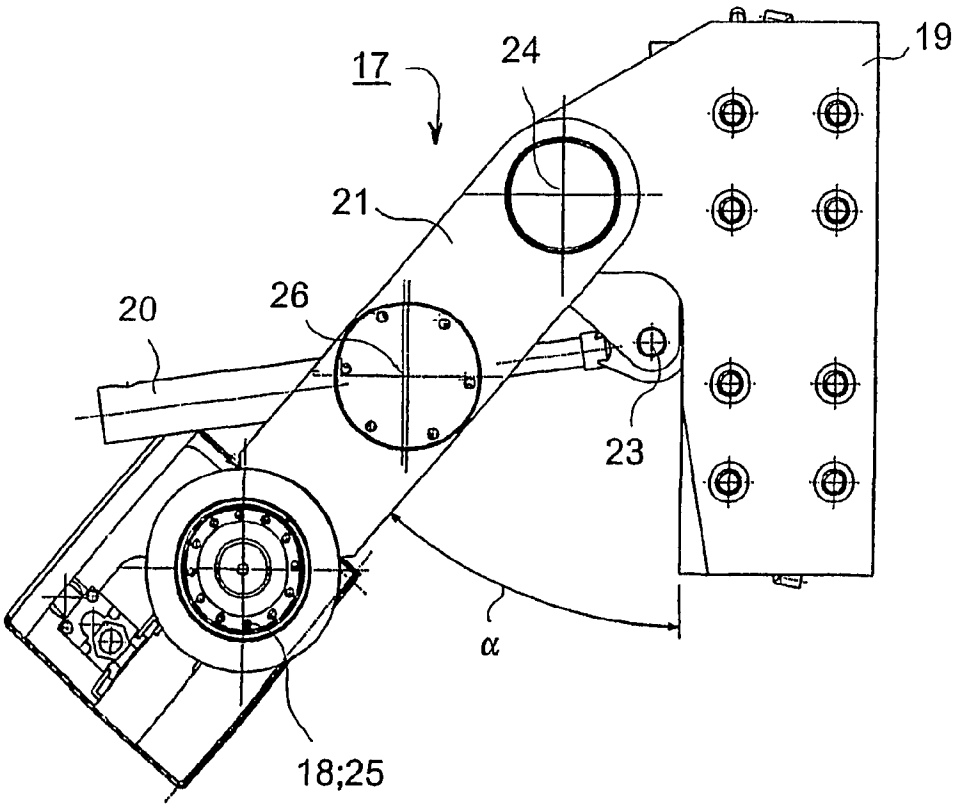

In accordance with one application of the invention shown in FIGS. 2A and 2B, an actuator 20, advantageously a cylinder—the figure shows a hydraulic cylinder arrangement but, for example, a semi-rotary actuator is also suitable—is placed in connection with the core locking device 17. As shown in the figure, when the pivoting angle $\alpha$ of the core chuck 17 increases, by means of the cylinder 20 a force is produced that acts on the center 18 of the core cancelling out the force caused by the pivoting angle $\alpha$. A structure connected with the slides 16 of the core chuck 17 is designated by 19 and the actuator 20 is attached to a pivot point 23 of the frame structure 19 and to a pivot point 26 of the pivoting arm 21 of the core chuck 17, which actuator 20 pivots when the angle $\alpha$ increases in a corresponding manner as the core chuck 17 pivots around the joint 24.

Figure 3:
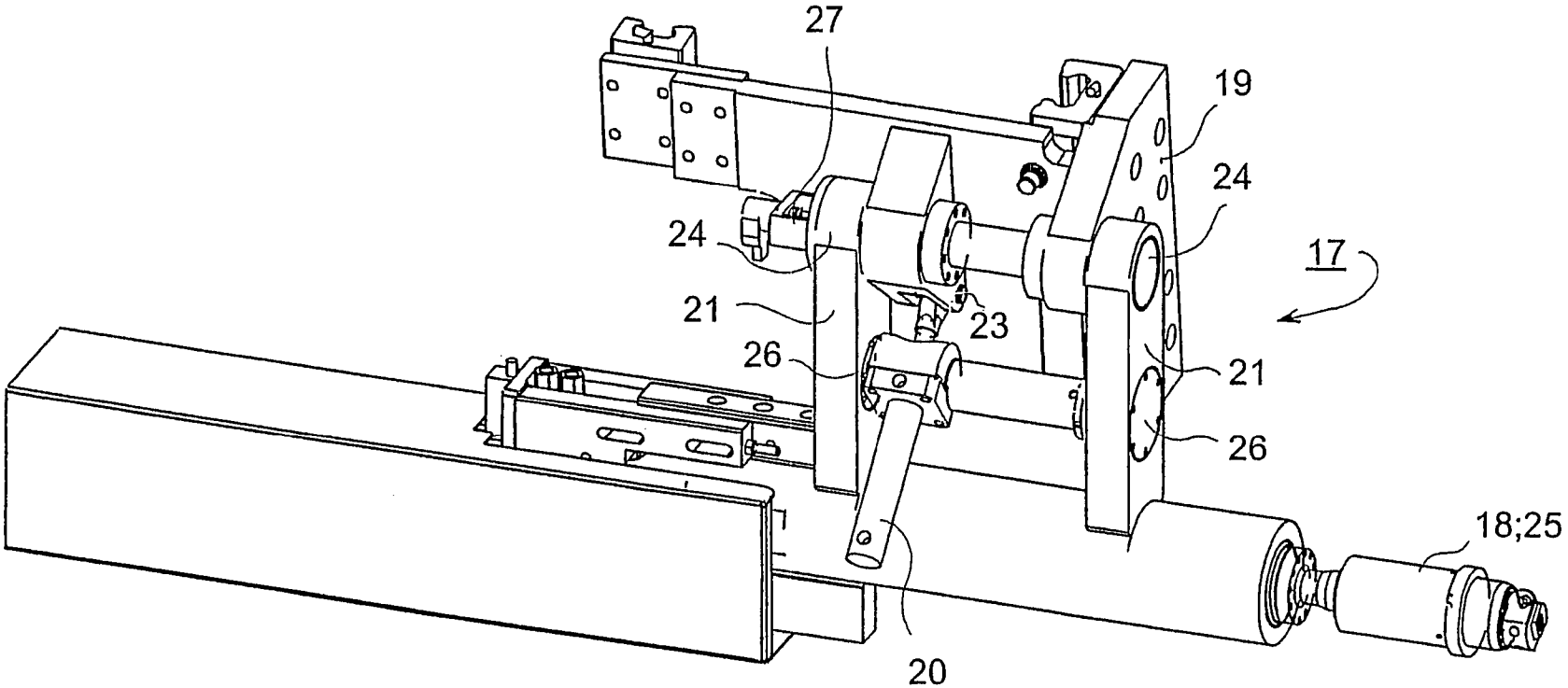
FIG. 3 schematically shows the core locking device in accordance with one application of the invention.

In FIG. 3, the parts of the core locking device or the core chuck 17 of the invention corresponding to those of FIGS. 2A and 2B are designated by the same reference signs. The actuator 20 in accordance with the invention, by means of which the force produced by the pivoted core chuck 17 in the center of the roll 10 is cancelled out, is attached through the pivot point 23 to the frame structure 19 of the core locking device 17, which frame structure 19 is connected to the slide 16 in the winder. In the figure, the locking member placed in the center 18 of the roll is designated by the reference numeral 25.

A sensor 27 is arranged in connection with the actuator 20 for detecting the pivoting angle $\alpha$ of the core locking device 17 to determine the magnitude of the necessary counterforce to be produced by means of the actuator 20 for cancelling out the force caused by the weight of the core locking device 17 at the angle $\alpha$.

The invention is in accordance with an advantageous application, the bouncing phenomenon can be detected and eliminated by means of the actuator 20 and the sensor 27.

Above, the invention has been described only with reference to some of its advantageous exemplifying embodiments, but the invention is not by any means meant to be narrowly limited to the details of them.

The invention claimed is:

1. A core locking device in a two-drum winder, comprising:

a locking member for locking the core locking device to a winding core of a roll to be wound on the two-drum winder, which core locking device is placed on a slide arranged in connection with the two-drum winder, which core locking device moves, as winding progresses, with a center of the roll being formed along the slide, the core locking device moving with the center of the roll being formed forwards on the slide, so that the core locking device will gradually be at an angle with respect to the slide, with the result that a force is produced in the center of the roll because of the weight of the core locking device;

an actuator arranged to produce a counterforce for the force caused by the mass of the core locking device in the changed position of the core locking device;

a frame structure mounted to the slide, the locking member being pivotably mounted to the frame structure; and an angle sensor arranged in connection with the actuator for measuring the pivoting angle of the locking member with respect to the frame structure to determine the magnitude of the necessary counterforce.

2. The core locking device of claim 1 wherein the actuator and the sensor are arranged to form an active damper in which the action of the actuator is changed based on the measurement result provided by the sensor.

3. The core locking device of claim 1 wherein the actuator and the sensor are arranged to serve as a device that detects a bouncing phenomenon.

4. The core locking device of claim 3 wherein the actuator and the sensor are arranged to serve as a device that detects and eliminates a bouncing phenomenon.

5. A core locking device for use with a two-drum winder having a first drum and a second drum, and a roll being wound thereon on a winding core, the two-drum winder having an upwardly extending slide, the core locking device having a weight and comprising:

a locking member for locking the core locking device to the winding core of the roll;

a frame structure mounted to the slide; the locking member being pivotably mounted to the frame structure so that during winding of the roll on the two-drum winder, the locking member pivots with respect to the frame structure and the slide;

a sensor disposed to measure a pivoting angle of the locking member with respect to the frame structure; and an actuator arranged to respond to the sensor to produce a counter force to a force caused by the weight of the core locking device as it pivots on the frame structure and to apply said counter force to the locking member.

6. The core locking device of claim 5, wherein the actuator is a hydraulic cylinder.

7. The core locking device of claim 5, wherein the actuator is a semi-rotary actuator.

8. The core locking device of claim 5 wherein the actuator and the sensor are arranged to form an active damper in which the action of the actuator is changed based on the measurement result provided by the sensor.

9. The core locking device of claim 5 wherein the actuator is arranged to form a passive damper in which the actuator is a hydraulic cylinder, a change in damping being achieved by changing the flow of the hydraulic cylinder.

10. The core locking device of claim 5 wherein the two-drum winder uses as one winding drum a set of drums around which a belt has been disposed, and wherein in a starting position of winding, a core is supported on the belt, the belt being subject to wear over time which causes the location of the starting position to change, the change of the starting position of winding caused by wear of the belt being capable of being compensated for by the location of the core locking device.

11. The core locking device of claim 5 wherein the force caused by the mass of the core locking device is static or dynamic.

12. The core locking device of claim 5 wherein the core locking device is disposed in connection with a variable geometry two-drum winder.

13. A method for winding a paper roll on a two-drum winder, comprising the steps of:

winding the paper roll about a core having a center which is supported on the two-drum winder, the core being locked to a locking member of a core locking device, the locking member being pivotably mounted to a frame structure which is mounted to a slide arranged in connection with the two-drum winder;

as winding progresses on the two-drum winder, measuring a pivot angle between the frame structure and the locking member, the core locking device moving with the center of the roll being formed along the slide so that the locking member pivots with respect to the frame structure and the slide, with the result that a force is produced in the center of the roll because of the weight of the core locking device; and producing a counterforce for the force caused by the weight of the core locking device as its position changes, and applying the counterforce to act upon the roll center.

14. The method of claim 13 further comprising the steps of measuring the pivot angle to detect a bouncing phenomenon.

15. The method of claim 14 further comprising the step of producing a counterforce by means of the actuator to eliminate the bouncing phenomenon upon detection thereof.

16. The method of claim 13 wherein the measurement of the pivot angle and the production of the counterforce serve to perform active damping.

17. The method of claim 13 wherein the step of producing the counterforce comprises applying a force through an actuator which extends between the locking members and the frame structure.

18. The method of claim 13 wherein the two-drum winder uses as one winding drum a set of drums around which a belt has been disposed, and wherein in a starting postion of winding, a core is supported on the belt, the belt being subject to wear over time which causes the location of the starting position to change, and further comprising the step of compensating for the change of the starting position of winding caused by wear by calibrating the core locking device and inferring the wear of the belt from the change in the location of the starting position.

* * * * *